US007620998B2

(12) United States Patent
Sandoval

(10) Patent No.: US 7,620,998 B2
(45) Date of Patent: Nov. 24, 2009

(54) REVERSIBLE SWEATSHIRT WITH SECURE POCKET SLOT AND SECURE INTERIOR POCKET POUCH

(76) Inventor: Louis Albert Sandoval, 15701 Royal Oak, Encino, CA (US) 91436

( * ) Notice: Subject to any disclaimer, the term of this patent is extended or adjusted under 35 U.S.C. 154(b) by 71 days.

(21) Appl. No.: 11/824,595

(22) Filed: Aug. 4, 2007

(65) Prior Publication Data

US 2009/0031468 A1 Feb. 5, 2009

(51) Int. Cl.
*A41D 13/00* (2006.01)

(52) U.S. Cl. ..... 2/69; 2/247; 2/253; 2/94

(58) Field of Classification Search ..... 2/247, 2/248, 249, 250, 253, 254, 94, 69, DIG. 2
See application file for complete search history.

(56) References Cited

U.S. PATENT DOCUMENTS 3,231,899 A * 2/1966 Seidel et al. ..... 2/93
2004/0187186 A1* 9/2004 Boezi ..... 2/84
2007/0266473 A1* 11/2007 Issel ..... 2/84
2008/0047045 A1* 2/2008 Atallah et al. ..... 2/93

* cited by examiner

*Primary Examiner*—Gary L Welch
*Assistant Examiner*—Alissa J Tompkins

(57) ABSTRACT

Reversible sweatshirt has a pair of contiguous configurations, each of which may have distinct coloration and distinct embroidery and a secure pocket slot, the application of such embroidery is facilitated through a secure pocket slot having a secure interior pocket pouch, accessible from one or more of the contiguous configurations, for safely securing items and for facilitating the embroidery process of both contiguous configurations. A wearer may select which side of the reversible sweatshirt to wars outside and/or inside, to expose the secure pocket slot and display the distinct coloration and distinct embroidery of the exposed configuration.

1 Claim, 2 Drawing Sheets

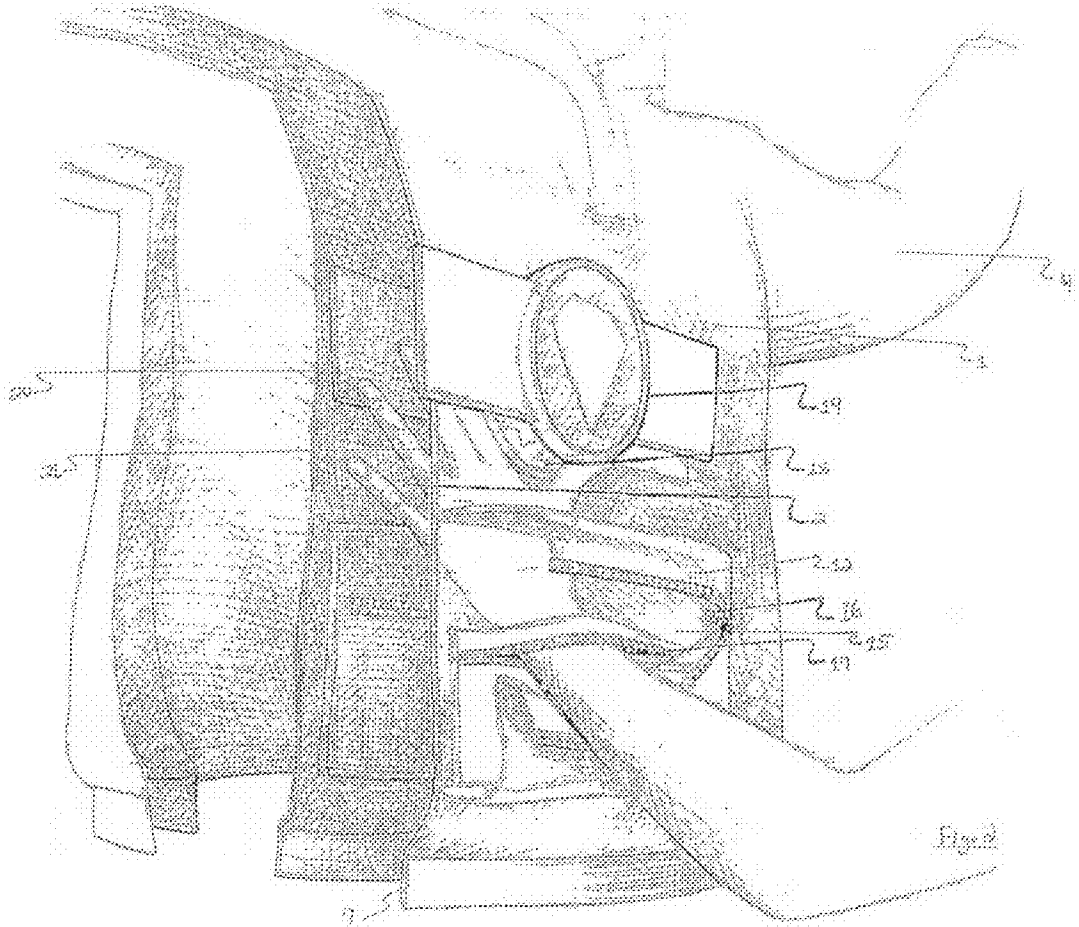

REVERSIBLE SWEATSHIRT WITH SECURE POCKET SLOT AND SECURE INTERIOR POCKET POUCH

BACKGROUND OF THE INVENTION

1. Field of the Invention

The present invention relates to clothing and more particularly, to reversible sweatshirts having secure pocket slots and secure interior pocket pouches, and that optionally present distinct embroidery in each exposed configuration.

2. The Prior Art

Sweatshirts are well known for their ease of manufacture and are commonly used in team athletics and booster clubs as a means to identify team allegiance. Often players and other team supporters require multiple sweatshirts as they either participate in or provide support to multiple sports, require the acquisition of multiple sweatshirts. This can present a particular problem, both in terms of the expense to acquire multiple sweatshirts and in the maintenance required of multiple sweatshirts. Additionally, the pouch pockets on sweatshirts do not provide for containing items securely, resulting in items falling from the pouch pockets and becoming lost.

One method which has been employed in an attempt to overcome the above disadvantages is the production of reversible team apparel (in particular sweatshirts) made from two overlapping pieces of fabric such that one piece of fabric form the inside layer of the item and the other piece of fabric forms the outside apparel layer. While this construction enables the ready switching by the wearer from one color of shirt to another as her or her team affiliation changes, the garments are generally labor intensive to embroider, requiring the disassembly and subsequent reassembly of the garment, and therefore it is generally expensive to produce garments with different embroidery on each apparel layer.

Thus it would be desirable to economically provide a garment that could be selectively reversed (that is turned inside out) by the wearer to display different embroidery in each configuration, so that they can be readily and easily identified with multiple teams, and to have pockets which hold items securely.

SUMMARY OF THE INVENTION

It is therefore an object of the present invention to provide a common approach and method for producing a reversible sweatshirt having secure pocket slots and secure interior pocket pouches with embroidery on the exterior bodice surface of each configuration. Each configuration includes a full bodice, hood and full sleeves for deployment on the inside or the outside of the sweatshirt, at the option of the wearer. The two configurations are free to shift with respect to each other, because they are stitched together only at restricted locations, such as at the hood, collar, cuffs and lower hem. Additionally, either configuration may include a pocket portion attached to the exposed bodice and forming symmetric left and right exterior pocket pouches. This pocket portion may also have a pocket slot formed neat the center of the top of the pocket portion and including an attached interior pocket pouch which lies between the interior surfaces of each configuration. The opening of the pocket slot, neat the attachment of the interior pocket pouch has a fastener such that this opening may be secured in the open or closed configuration. The bottom of the interior pocket pouch also has an opening which has a fastener such that this Opening may be secured in the open or closed configuration. Items may be safely stored in the interior pocket pouch when these fasteners are secured in the closed position. The opening of the pocket slot, the interior pocket pouch and the opening at the bottom of the interior pocket pouch are of a size sufficient to allow the easy passage of the inner portion of an interlocking embroidering frame. By inserting the inner portion of an interlocking embroidering frame through the pocket slot and interior pocket pouch to between the inner surfaces of each configuration, a configuration may be secured between the inner surface frame and the outer surface frame when the inner surface frame and outer surface frame are interlocked. Interlocking a configuration in this way secures the configuration such that each configuration may be readily customizable by the application of embroidery on the bodice of each exposed configuration by using an embroidery machine.

BRIEF DESCRIPTION OF THE DRAWINGS

The features of the invention are believed to be novel and the elements characteristic of the invention are set forth with particularity in the appended claims. For a fuller understanding of the nature and object of the present invention, reference is made to the following detailed description of the preferred embodiments taken in conjunction with the accompanying drawings, wherein:

FIG. 2 is a perspective cut-away of a side and a view of the front of a sweatshirt when inserting the inner portion of an interlocking embroidering frame through the pocket slot and interior pocket pouch to between the inner surfaces of each configuration, and securing a surface of a configuration between the inner surface of an interlocking embroidering frame and the outer surface of an interlocking embroidering frame.

DETAILED DESCRIPTION OF THE PREFERRED EMBODIMENTS

Figure 1:
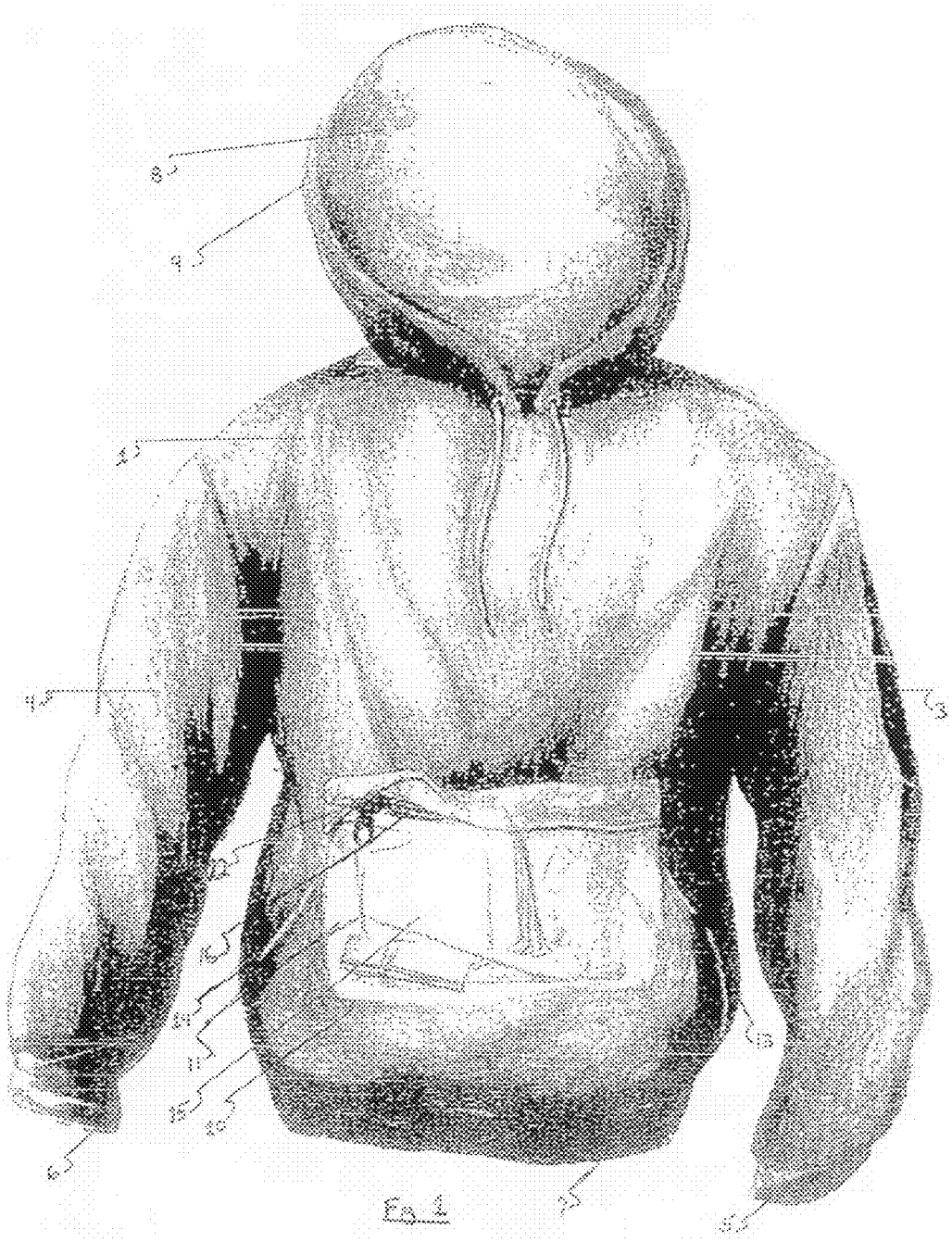
FIG. 1 is a perspective view of the outer surface of one configuration, wherein the interior pocket pouch is drawn to expose the fastener of the pocket slot as well as in relief to show the inner pocket pouch.

The present invention will now be described more fully hereinafter with reference to the accompanying drawings, in which preferred embodiments of the invention are shown. This invention may, however, be embodied in many different forms and should not be construed as limited to the embodiments set forth herein; rather these embodiments are provided so that this disclosure will be thorough and complete, and will fully convey the scope of the invention to those skilled in the art. Like numbers refer to like elements throughout.

The Embodiment of FIGS. 1 and 2

The embodiment of FIGS. 1 and 2 is shown as comprising the exposed bodice of one reversible configuration. As shown the exposed configuration is of conventional appearance having a knot face 1 and a pile back 2. The cuffs of sleeves 3 and 4 are joined by stitching at 5 and 6, the waist of the bottom portion 10 is joined by stitching at 7, and the edge of the hood 8 is joined by stitching at 9.

Referring to FIG. 1, the bottom portion 10 includes a pocket portion 11 attached to the exposed bodice and forming symmetric left 13 and right 14 exterior pocket pouches. A pocket slot 12 is formed at the top portion of the pocket portion 11 and an interior pocket pouch 15 is sown directly onto the interior of the pocket slot 12 and lying between the interior surfaces of each configuration behind the pocket portion 11. The pocket slot 12 also includes a fastening device (a zipper, Velcro and the like) 16, to secure the pocket slot 14 in either the open or closed position.

Referring to FIG. 2, the bottom end of the interior pocket pouch 15 includes a fastening device (a zipper, Velcro and the like) 17, to secure the pocket slot in either the open or closed position. When the fastening device 16 on the pocket slot 12 and the fastening device 17 on the interior pocket pouch 15 are secured in the open position, the inner portion of an interlocking embroidering frame 18 may be passed to between the inner surface 2 of the unexposed configuration and the interior surface 21 of eh exposed configuration. The interior surface 21 and the exterior surface 1 of the exposed configuration may be secured between the inner surface frame 18 and the outer surface frame 19, when the inner surface frame 18 and the outer surface frame 19 are interlocked and then embroidered using an embroidery machine. Likewise, the interior surface 2 and the exterior surface 20 of the unexposed configuration may be secured between the inner surface frame 18 and the outer surface frame 19, by interlocking such surfaces between the inner surface frame 18 and the outer surface frame 19 and then embroidered using an embroidery machine.

As will be readily appreciated by those having ordinary skill in the art, the ability to embroider different designs on each configuration is made possible by the ability to secure each configuration separately from the other within interlocking embroidering frame. Such use of an interlocking frame is greatly simplified by the ability to easily place the inner surface frame between the inner surface of each configuration, as facilitated by the pocket slot and the opening of the interior pocket pouch. By utilizing such openings, the expense of disassembly and subsequent reassembly of the reversible sweatshirt is avoided. Further, the fasteners on the pocket slot and interior pocket pouch allow items to be safely stored in the interior pocket pouch when these fasteners are secured in the closed position.

What is claimed is:

1. A reversible sweatshirt comprising a first textile configuration and a second textile configuration, said configurations being opposed contiguously, each said configuration including a bodice and sleeves for deployment on the inside or the outside of the sweatshirt, at the option of the wearer, and stitched together at their necks, cuffs and lower hem, and at least one of said configurations having a bodice portion with a pocket portion, said pocket portion having a top portion and a bottom portion and said pocket portion attached to the proximal portion of said bodice portion thereby forming symmetric left and right exterior pocket pouches; and where in at least one of said configurations including said pocket portion having a pocket slot configuration at the center of said top portion and said pocket slot having an interior and an exterior surface, wherein said pocket slot having an interior pocket pouch attached to said interior surface of said pocket slot and said interior pocket pouch having a top portion and a bottom portion, said top portion attached to said interior surface of said pocket slot and interior pocket pouch lying between said configurations, and said pocket slot sized so as to facilitate the embroidery of said bodice of such first configuration and said second configuration, and wherein said pocket slot having a fastener attached to said exterior surface of said pocket slot so as to secure pocket slot in the open position or in the closed position, and said interior pocket pouch sized so as to accommodate the storage of a plurality of items and to facilitate the embroidery of said first configuration and said second configuration, said top portion of said interior pocket pouch attached directly into the interior surface of said pocket slot, and said bottom portion of said interior pocket pouch having a fastener attached so as to secure said interior pocket pouch in the open position or in the closed position.

* * * * *